US006863161B2

(12) United States Patent
Mearns et al.

(10) Patent No.: US 6,863,161 B2
(45) Date of Patent: Mar. 8, 2005

(54) METHOD AND ARRANGEMENT FOR TELEMONITORING AN ELEVATOR TO DETERMINE ITS NEED FOR MAINTENANCE

(75) Inventors: John Mearns, Hoofddorp (NL); Tapio Tyni, Hyvinkää (FI); Pekka Perälä , Helsinki (FI); Nils-Robert Roschier, Vantaa (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/832,291

(22) Filed: Apr. 27, 2004

(65) Prior Publication Data

US 2004/0206583 A1 Oct. 21, 2004

Related U.S. Application Data

(63) Continuation of application No. PCT/FI03/00085, filed on Mar. 2, 2003.

(30) Foreign Application Priority Data

Feb. 5, 2002 (FI) ..... 20020234

(51) Int. Cl.[7] ..... B66B 3/00
(52) U.S. Cl. ..... 187/391; 187/247; 706/910
(58) Field of Search ..... 187/247, 248, 187/391–396; 340/502, 503, 514–516, 539.1, 539.14, 3.1, 815.81; 706/909, 910, 918

(56) References Cited

U.S. PATENT DOCUMENTS 3,973,648 A * 8/1976 Hummert et al. ..... 187/393
4,002,973 A * 1/1977 Wiesendanger et al. .... 187/391
4,330,838 A 5/1982 Yoneda et al.
4,622,538 A * 11/1986 Whynacht et al. ..... 340/506
4,698,780 A * 10/1987 Mandel et al. ..... 187/393
4,930,604 A * 6/1990 Schienda et al. ..... 187/393
5,027,299 A * 6/1991 Uetani ..... 702/122
6,325,179 B1 * 12/2001 Barreiro et al. ..... 187/393
6,330,935 B1 12/2001 Systermans
6,484,125 B1 * 11/2002 Huang et al. ..... 702/183

FOREIGN PATENT DOCUMENTS

GB 2226428 A 6/1990
JP 02070683 A * 3/1990 ..... B66B/5/00
JP 06316387 A * 11/1994 ..... B66B/3/00
JP 11228046 A * 8/1999 ..... B66B/3/00
JP 2001341952 A * 12/2001 ..... B66B/3/00
JP 2003192248 A * 7/2003 ..... B66B/5/00
WO WO01/14237 A1 3/2001
WO WO03/066497 A1 8/2003

* cited by examiner

*Primary Examiner*—Jonathan Salata
(74) *Attorney, Agent, or Firm*—Birch, Stewart, Kolasch & Birch, LLP

(57) ABSTRACT

Method for telemonitoring the condition and state of an elevator and for determining its need for maintenance by performing an automatic test run of the elevator car (1) in the elevator shaft (2) to collect data for use in an elevator telemonitoring process. The method of the present invention is characterized in that the aforesaid test run comprises a number of automatic test run cycles synchronized with respect to each other.

26 Claims, 3 Drawing Sheets

METHOD AND ARRANGEMENT FOR TELEMONITORING AN ELEVATOR TO DETERMINE ITS NEED FOR MAINTENANCE

This application is a Continuation of co-pending PCT International Application No. PCT/FI03/00085 filed on Mar. 2, 2003, which designated the United States, and on which priority is claimed under 35 U.S.C. § 120, which claims priority under 35 U.S.C. § 119(a) on patent application Ser. No(s). 20020234 filed in Finland on Feb. 5, 2002, the entire contents of which are hereby incorporated by reference.

FIELD OF THE INVENTION

The present invention relates to a method for telemonitoring the condition and state of an elevator and for determining its need for maintenance. The invention also relates to an arrangement for telemonitoring the condition and state of an elevator and for determining its need for maintenance.

BACKGROUND OF THE INVENTION

Condition monitoring refers to the procedures whereby the condition of equipment is generally observed by measuring parameters the changes of which reflect a change in the condition of the equipment. In condition monitoring in general, the condition of equipment is monitored regularly and when the condition changes, a more accurate fault diagnosis can be made. Fault diagnostics again refers to the procedures used to detect and identify a fault and to determine the cause of the fault. The most important function of a fault diagnostics system is to detect the fault reliably and safely as early as possible. Sometimes a fault diagnostics system is programmed to suggest a solution for eliminating the fault detected. The aforesaid principle is also utilized in telemonitoring of the condition and state of elevators and likewise in the determining of the need for preventive maintenance of elevators.

In telemonitoring of the condition and state of elevators, the elevators themselves provide and indication of faults to be expected. Thus, the degree of wear of components can be detected before they break down completely. It is therefore possible to preset a fixed target value for the failure frequency of elevators to measure the reliability and quality of the elevator. For example, the target per annum for each elevator could be set at only one fault interrupting the passenger's elevator journey.

The aim of preventive maintenance of an elevator is to eliminate the deterioration of the condition and performance of the equipment occurring in consequence of environmental effects, use and wear. Environmental factors and harder-than-anticipated use accelerate wear of the elevator and may lead to faults. For example, transporting big and heavy objects on an elevator designed for passenger traffic may result in a loosening of joints, changes of adjustments and impairment of the quality of operation of the elevator. Environmental factors such as dust, dirt, temperature and moisture additionally affect the condition and rate of wear of the elevator. If the elevators are not serviced in time, they may develop faults that either prevent passengers from using the elevator at all or impair the quality of operation of the elevator in a decisive way, e.g. the door operation becomes noisy or too slow. The scheduling of preventive maintenance of elevators has conventionally been done either via periodic visits set on certain dates in the calender or based on the extent of usage.

Prior-art technology is described in published application GB 2226428 (B66B 5/02), from which a telemonitoring and diagnostics system comprising several elevators and their monitoring terminals and a telemonitoring center communicating with them is known. Each elevator monitoring terminal observes the history and state of operation and deviations from the normal state of the elevator and sends the information periodically to the maintenance center, which generates the maintenance commands. This system is used to monitor door faults, door drives, condition of the motor, the stopping position and brakes of the elevator, operation of the control system, rope elongation, etc.

The maintenance center, communicating with the aforesaid elevator monitoring terminals over telephone lines, is provided with a diagnostics program and a monitor for receiving and analyzing the operation data and history. By these means, based on information obtained from the operation history of the elevators, the system tries to prevent faults caused by aging.

The known state of the art is also represented by published application JP228046/1999, which discloses a telemonitoring system for elevators. In this system, information is collected from inside the elevator by means of cameras and microphones, and the information describing the condition of the car is sent to a telemonitoring unit, whereafter a decision making unit makes decisions regarding abnormal conditions. Problem situations detected are reported to the telemonitoring center. In this system, the elevator in which problems have been detected is also sent instructions for coping with the problems. In the system presented in this publication, the cameras and microphones are active even when passengers are present in the elevator.

The problem with prior-art solutions is that the information collected about the elevator is not necessarily always sufficiently accurate, in consequence of which the elevator telemonitoring system may give a false alarm based on an incorrect interpretation.

SUMMARY OF THE INVENTION

The object of the present invention is to overcome the drawbacks of the aforesaid prior art.

The method of the invention provides significant advantages as compared with prior-art technology.

The advantage achieved by the invention is that the information collected about the elevator is sufficiently accurate because the test run comprises several test run cycles of equal length in time and distance and synchronized with each other in respect of the duration of and distance traveled during the test run. Therefore, it is possible to compare the information collected during different test run cycles because on each test run cycle the elevator car is always at the same floor after the same length of time. Thus, it is also possible to more effectively prevent the possibility of a false elevator fault alarm.

The present invention concerns a method for telemonitoring the condition and state of an elevator and determining its need for maintenance by performing an automatic test run of the elevator car in the elevator shaft to collect information for use by an elevator telemonitoring process. According to the method of the invention, the aforesaid test run comprises several automatic test run cycles synchronized with each other so that information is collected as a function of time and traveling distance of the elevator car. According to a preferred embodiment of the invention, the number of test run cycles mentioned above is three. In the method, information is collected by means of devices provided in connection with the elevator car for collecting audio data and video data and door data and car movement data and car stopping data for use as measurement data. These aforesaid measuring devices collecting measurement data include e.g. video cameras, microphones, acceleration sensors, car load weighing devices, photocells, etc.

Several test run cycles as mentioned above are performed, their number being not limited in any way. The number of test run cycles performed is preferably three.

According to a preferred embodiment of the invention, the method comprises testing whether the test run cycles for testing the elevator car can be started by testing in some way before starting the test run cycles whether the aforesaid elevator car is empty, e.g. by checking by some method or means whether there are people or goods present in the elevator car.

According to the method of the invention, as the starting place for the aforesaid elevator car is sought a given floor, whereupon car calls to the other floors are issued to begin a first test run cycle of the elevator car from the starting place, and the audio and video data of a first video camera placed inside the elevator car and the door data and car movement data and car stopping data are saved as measurement data.

According to the method of the invention, as the starting place for the aforesaid elevator car is sought a given floor, whereupon car calls to the other floors are issued and then a second test run cycle of the elevator car is started from the starting place, the audio and video data of a second video camera placed below the elevator car and the door data and car movement data and car stopping data are stored as measurement data.

According to the method of the invention, as the starting place for the aforesaid elevator car is sought a given floor, whereupon car calls to the other floors are issued and then a third test run cycle of the elevator car is started from the starting place, the audio and video data of a third video camera placed on top of the elevator car or in the machine room of the elevator and the door data and car movement data and car stopping data are stored as measurement data.

According to the method of the invention, a mean value is calculated from the measurement data comprising the door data and car movement data and car stopping data for the first, second and third test run cycles of the aforesaid elevator car. After this, according to the invention, the mean value thus calculated is compared to a reference value corresponding to a normal condition or state of the elevator.

The invention also relates to an arrangement for telemonitoring the condition and state of an elevator and determining its need for maintenance by performing an automatic test run of the elevator car in the elevator shaft to collect information for use by an elevator telemonitoring process. According to the present invention, the arrangement comprises video cameras provided in connection with the elevator car for collecting video data and audio data, and door data and car movement data and car stopping data, which are collected and are stored during a test run comprising a number of automatic test run cycles synchronized with each other.

According to a preferred embodiment of the invention, arranged in connection with the elevator car is a first video camera placed inside the elevator car for collecting video and/or audio data and a second video camera placed below the aforesaid elevator car. According to the invention, arranged in connection with the elevator car is a third video camera collecting video and/or audio data and placed on top of the aforesaid elevator car or alternatively in the machine room of the elevator in immediate vicinity of the drive machine of the elevator.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail with reference to the attached drawings, which are given by way of illustration only, and thus are not limitative of the present invention, and wherein.

DETAILED DESCRIPTION OF THE INVENTION

Figure 1A:
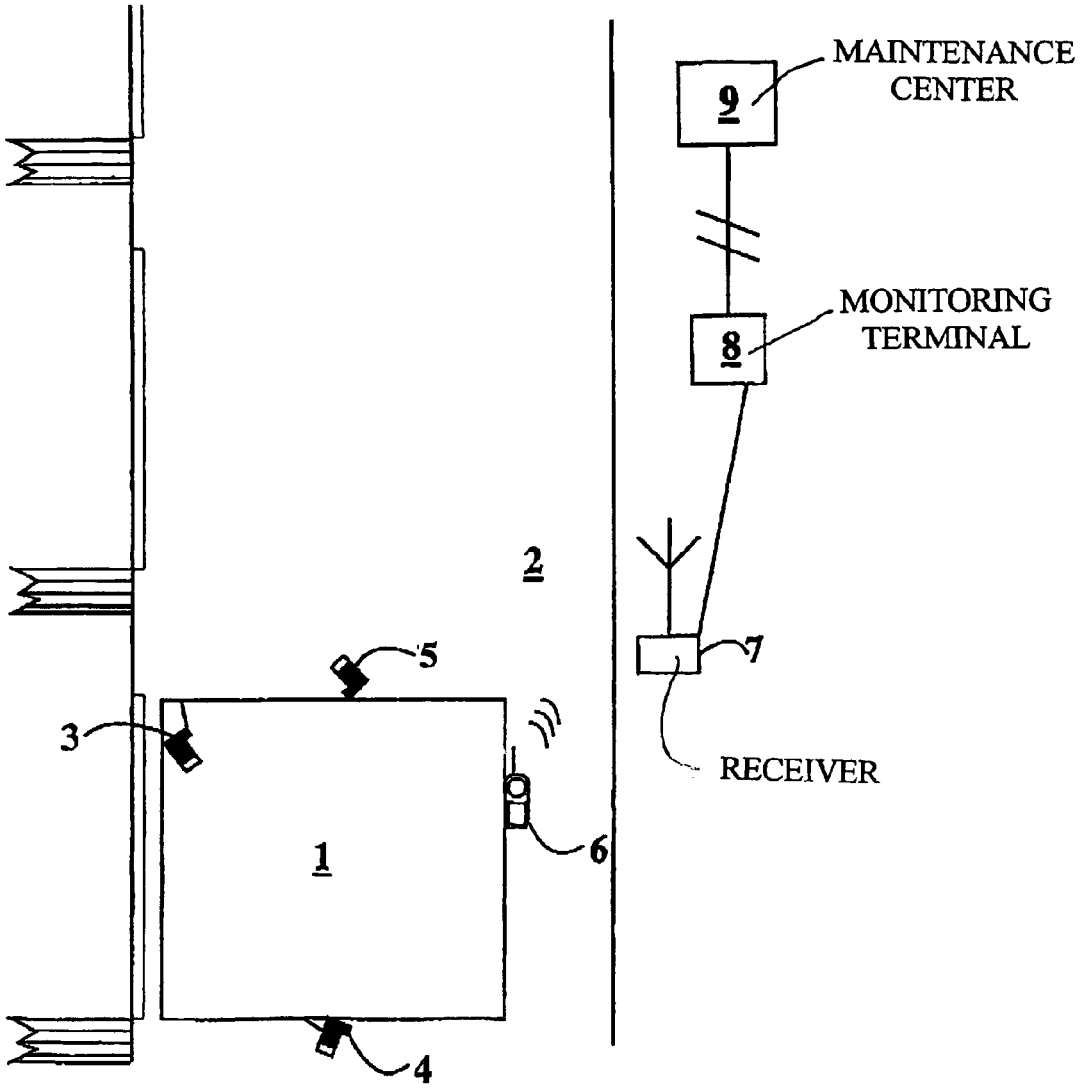
FIG. 1A represents an arrangement according to the best embodiment of the invention for telemonitoring the condition and state of an elevator.

FIG. 1A represents an arrangement according to the best embodiment of the invention for telemonitoring the condition and state of an elevator, wherein the condition and state of the elevator are telemonitored and its need for maintenance is determined by performing an automatic test run of the elevator car 1 in the elevator shaft to collect information for use in an elevator telemonitoring process.

The above-mentioned arrangement comprises video cameras 3, 4, 5 provided in connection with the elevator car 1, which are used to collect information for use in the telemonitoring of the condition and state of the elevator. Also provided in connection with the elevator are means for collecting door data and means for collecting car movement data and means for collecting car stopping data, which are likewise used to collect information for use in the telemonitoring of the condition and state of the elevator. The elevator car 1 comprises a wireless transmitter 6 for transmitting the collected measurement data to a receiver 7, which communicates with an elevator-specific monitoring terminal 8 provided with a special card. This aforesaid monitoring terminal 8 again sends the measurement data over a communication link to a maintenance center 9 for analysis. The aforesaid communication link for transmitting the measurement data may preferably consist of a telephone connection or an Internet connection or some other wireless connection.

According to this embodiment, the aforesaid video cameras collecting information about the elevator are so disposed that the first video camera 3 is placed inside the elevator car 1 and the second video camera 4 is placed below the elevator car 1 while the third video camera 5 is placed on top of the elevator car 1.

Figure 1B:
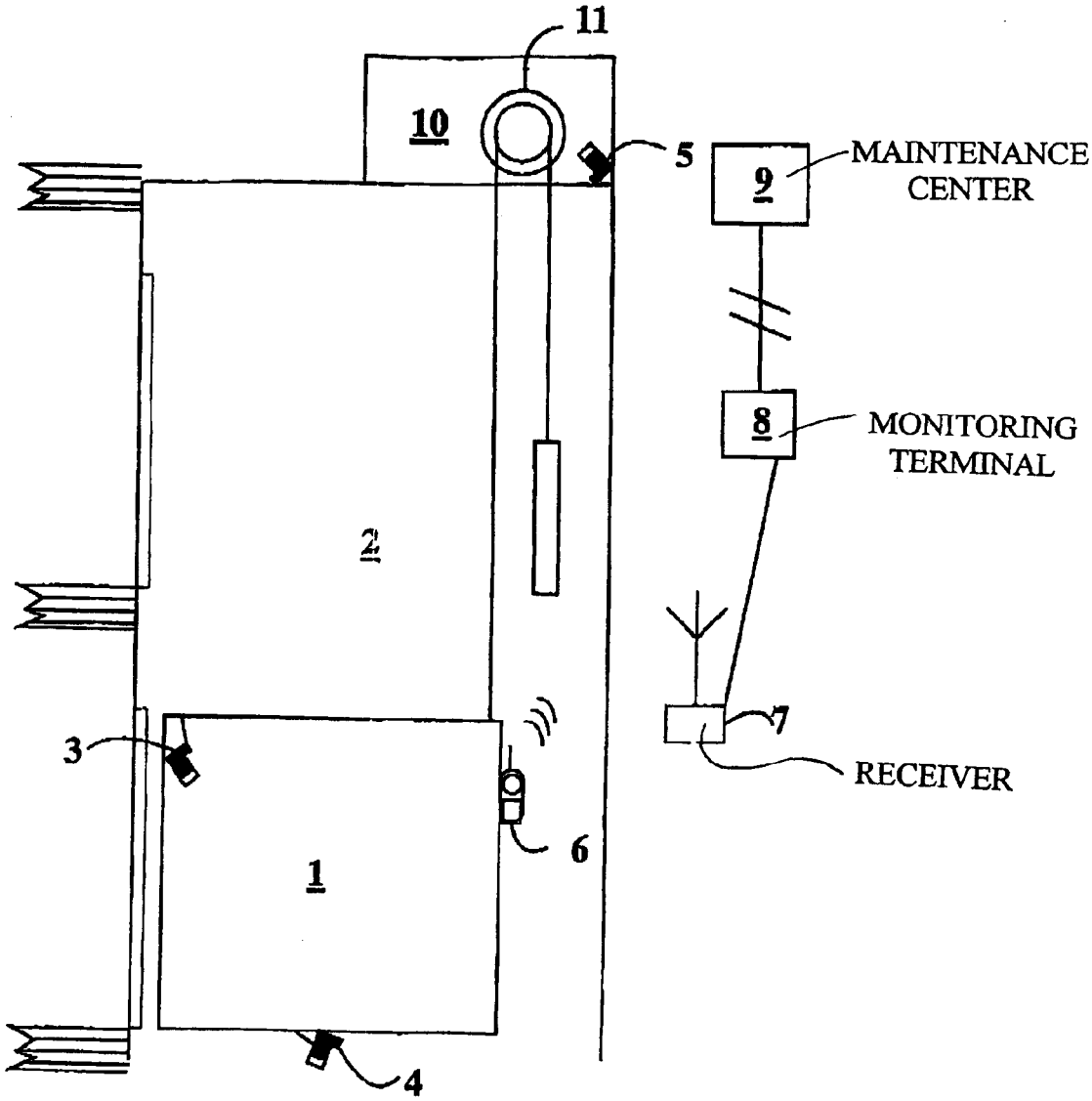
FIG. 1B represents another arrangement according to the invention for telemonitoring the condition and state of an elevator.

FIG. 1B represents another arrangement for monitoring the condition of an elevator, which is like the arrangement for telemonitoring the condition and state of an elevator except that the third video camera 5 collecting information is disposed in the immediate vicinity of the elevator drive machine 11 in the machine room 10 of the elevator. This arrangement is advantageous in the detection of faults occurring in the drive machine 11 of the elevator.

Figure 2:
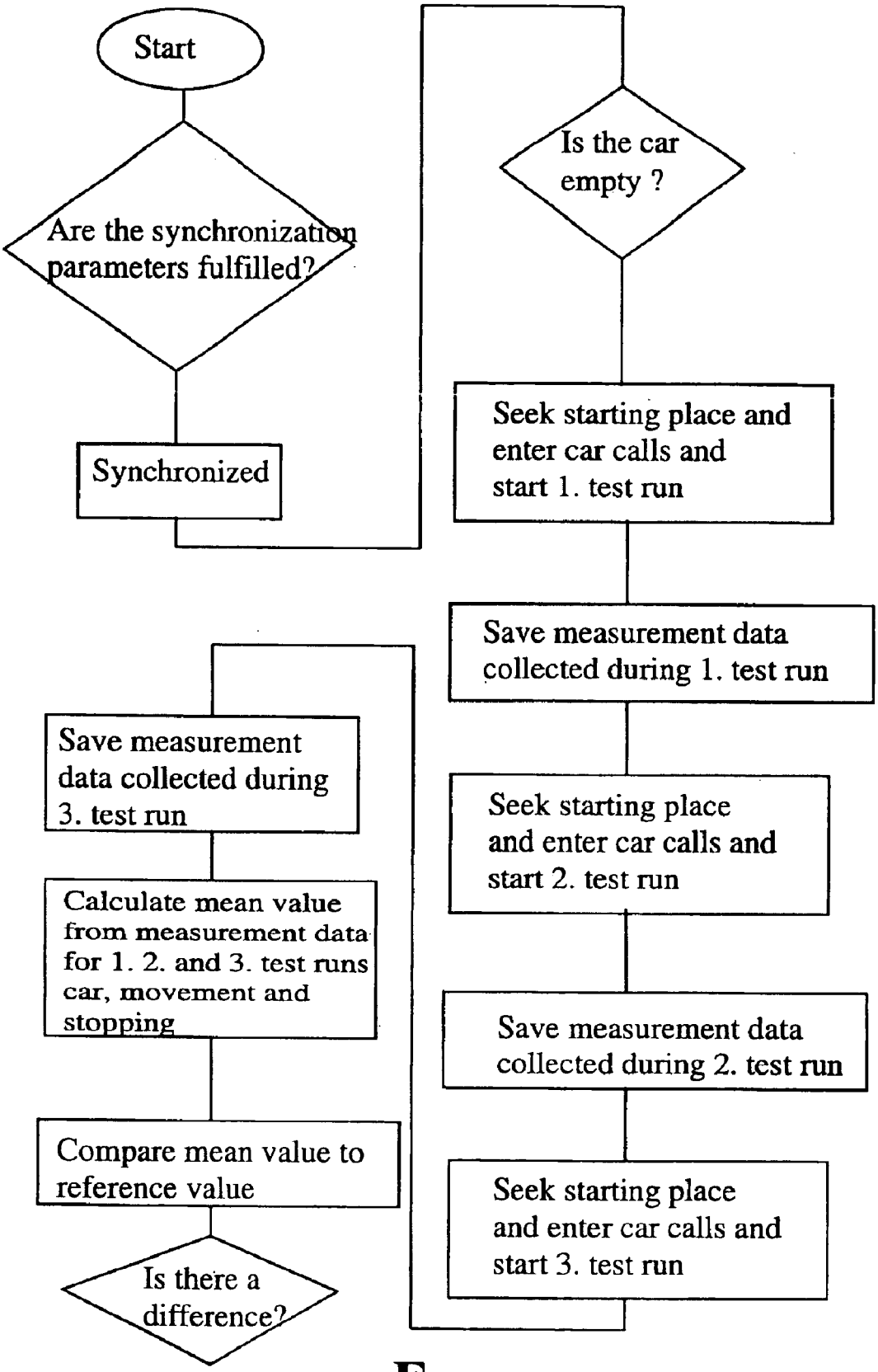
FIG. 2 presents a block diagram visualizing the method of the invention.

FIG. 2 visualizes a method according to the present invention associated with the telemonitoring of elevators, in the form of a block diagram visualizing the method of the invention as a step-by-step procedure.

The invention discloses a method for telemonitoring the condition and state of an elevator and determining its need for maintenance by performing an automatic test run of an elevator car 1 in an elevator shaft 2 to collect information for use in an elevator telemonitoring process. The method of the invention is characterized in that the aforesaid test run comprises several automatic test run cycles synchronized with each other. According to a preferred embodiment of the invention, the number of above-mentioned test run cycles is three.

In the method, first a check is carried out to establish whether all the synchronization parameters are fulfilled. If all the aforesaid synchronization parameters are fulfilled, then it is concluded that synchronization prevails, whereupon the aforesaid test run cycles are started. This an essential feature of the invention, because the automatic test run cycles according to the invention can thus be carried out in synchronization with each other, rendering the aforesaid test run cycles mutually comparable so that comparable data is produced during them. One of the most important synchronization parameters is the traveling times between the floor designated as the starting floor and each one of the other floors, which traveling times must be the same on each test run cycle. Another synchronization parameter is the stopping time at each floor during each test run cycle, which stopping times preferably must be the same for each floor during every test run cycle.

During the test run cycles of the elevator to be telemonitored, audio and video data and door data and car movement data and car stopping data is collected as measurement data by using means specially applicable for this purpose.

In the method of the invention, a test is performed to establish whether it is possible to carry out the test run cycles of the aforesaid elevator car 1. This can be implemented by testing in some way before starting the test run cycles whether the aforesaid elevator car 1 is empty. This may be based e.g. on utilizing the car load weighing device so that, the weight of an empty car being known, it will be established before starting the test run cycles whether there are any people present in the aforesaid elevator car 11 or not.

During the next step in the procedure according to the method of the invention, as the starting place for the aforesaid elevator car 1 is sought a given floor, whereupon car calls to the other floors are issued, whereupon the first test run cycle of the aforesaid elevator car 1 is started from the aforesaid floor designated as the starting place, and the audio and video data of the first video camera 3 placed inside the aforesaid elevator car 1 and the door data and car movement data and car stopping data are stored as the measurement data obtained for the first test run cycle.

During the next step in the procedure according to the method of the invention, as the starting place for the aforesaid elevator car 1 is sought a given floor, whereupon car calls to the other floors are issued, whereupon the second test run cycle of aforesaid elevator car 1 is started from the aforesaid floor designated as the starting place, and the audio and video data of the second video camera 4 placed below the aforesaid elevator car 1 and the door data and car movement data and car stopping data are stored as the measurement data obtained for the second test run cycle.

After this, according to the method of the invention, as the starting place for the aforesaid elevator car 1 is sought a given floor, whereupon car calls to the other floors are issued, whereupon the third test run cycle of the aforesaid elevator car 1 is started from the aforesaid floor designated as the starting place, and the audio and video data of the third video camera 5 placed on top of the aforesaid elevator car 1 or in the elevator machine room and the door data and car movement data and car stopping data are stored as the measurement data.

At this stage, the measurement data for each test run cycle have been stored for used in the elevator condition monitoring system.

After this, based on the method, a mean value is calculated from the measurement data comprising the door data and car movement data and car stopping data for the first, second and third test run cycles of the aforesaid elevator car 1.

Next, the mean value thus calculated is compared to a reference value corresponding to a normal condition or state of the elevator. Based on this comparison, the elevator condition monitoring system knows whether a failure is likely to occur in the elevator system in the near future or not. Thus, it is possible to start preventive maintenance operations in time before a failure occurs and to prevent the interruption of the elevator journey of passengers who may be present in the elevator car.

According to the invention, the aforesaid first, second and third test run cycles of the aforesaid elevator car 1 are preferably started from the same floor designated as the starting floor.

According to an embodiment of the method of the invention, the floor designated as the starting place of the test run cycle for the aforesaid elevator car 1 may be the top floor.

According to another embodiment of the invention, the aforesaid first, second and third test run cycles of the aforesaid elevator car 1 are synchronized so that each floor-to-floor trip is started with a separate synchronization. In this case, each car call is issued from the destination floor of the previous car call. For example, the elevator car is driven from the first floor to the second floor and a car call to the next i.e. third floor is not given until the door has been closed and the elevator is ready to continue. By dividing the test run cycles into short stretches in this manner, the error accumulated during the test run cycle is minimized, which is advantageous especially in the case of high buildings.

In addition, according to the method, the test run cycles of the aforesaid elevator car 1 are repeated as many times as necessary, measuring the same or different information.

In the foregoing, the invention has been described by way of example with reference to the attached drawings while different embodiments of the invention are possible in the scope of the inventive concept defined in the claims.

What is claimed is:

1. A method for telemonitoring the condition and state of an elevator and for determining need for maintenance comprising the steps of performing an automatic test run of an elevator car in an elevator shaft to collect data for use in an elevator telemonitoring process, the test run comprises a number of automatic test run cycles synchronized with respect to each other so that information is collected as a function of time and distance travelled by the elevator car, the test run cycles include car calls being sequentially issued for different destination floors, successive car calls being issued after the elevator car has reached a selected floor and a predetermined time has passed.

2. The method according to claim 1, wherein the test run comprises three test run cycles.

3. The method according to one of claims 1 or 2, wherein during the test run cycles, audio data and video data and door data and car movement data and car stopping data are collected.

4. The method according to claim 3, wherein an initial test is executed to determine whether to start the test run cycles of the elevator car.

5. The method according to claim 3, wherein before the test run cycles are started, a test is executed to determine whether the elevator car is empty.

6. The method according to claim 1, wherein before the test run cycles are started, the elevator car is checked for presence of people in the car.

7. The method according to claim 1, wherein as the starting place for the elevator car is sought a given floor, whereupon car calls to other floors are issued, whereupon the first test run cycle of the elevator car is started from the starting place, audio and video data of a first video camera placed inside the elevator car and the door data and car movement data and car stopping data are saved as measurement data.

8. The method according to claim 7, wherein for the second test run cycle as the starting place for the elevator car is sought a given floor, whereupon car calls to other floors are issued, whereupon the second test run cycle of the elevator car is started from the starting place, audio and video data of a second video camera placed below the elevator car and the door data and car movement data and car stopping data are stored as measurement data.

9. The method according to claim 8, wherein for the third test run cycle as the starting place for the elevator car is sought a given floor, whereupon car calls to the other floors are issued, whereupon the third test run cycle of the elevator car is started from the starting place, audio and video data of a third video camera placed on top of the elevator car or in the machine room of the elevator and the door data and car movement data and car stopping data are stored as measurement data.

10. The method according to claim 9, wherein a mean value is calculated from the measurement data comprising the door data and car movement data and car stopping data for the first, second and third test run cycles of the elevator car.

11. The method according to claim 10, wherein the mean value calculated is compared to a reference value corresponding to a normal condition or state of the elevator.

12. The method according to claim 9, wherein for the first, second and third test run cycles of the elevator car are started from the same floor designated as the starting place.

13. The method according to claim 1, wherein first, second and third test run cycles of the elevator car are started from the same floor designated as the starting place.

14. The method according to claim 1, wherein first, second and third test run cycles of the elevator car are started from the top floor.

15. The method according to claim 1, wherein first, second and third test run cycles of the elevator car are synchronized so that each floor-to-floor trip is started with a separate synchronization.

16. The method according to claim 1, wherein the test run cycles of the elevator car are repeated to measure the same or different information.

17. The method according to claim 1, wherein the test run cycles are synchronized by individual tests having information collected about each test for each of the test run cycles, the tests collecting measurement data including door data, car movement data, and car stopping data, a plurality of test run cycles being completed and a mean value for each of the tests for each tested floor and each tested elevator car being compared against reference values corresponding to a normal condition or state of the elevator.

18. The method according to claim 17, wherein first, second and third test run cycles of the elevator car are synchronized so that each floor-to-floor trip is started with a separate synchronization.

19. The method according to claim 1, wherein video cameras are mounted both inside and outside the elevator car, all of the video cameras being used to collect information in the test run cycles.

20. An arrangement for telemonitoring the condition and state of an elevator and for determining need for maintenance by performing an automatic test run of an elevator car in an elevator shaft to collect data for use in an elevator telemonitoring process, the arrangement comprises video cameras provided both inside and outside the elevator car and a door data collector for collecting door data, a car movement data collector for collecting car movement data, a car stopping data collector for collecting car stopping data, the collectors being used to collect information during the test run, which comprises several test run cycles.

21. The arrangement according to claim 20, wherein the video cameras include a first video camera for collecting video and/or audio data, disposed inside the elevator car, and a second video camera disposed below the elevator car.

22. The arrangement according to claim 21, wherein the video cameras include a third video camera for collecting video and/or audio data, disposed on top of the elevator car.

23. The arrangement according to claim 21, wherein the video cameras include a third video camera for collecting video and/or audio data, disposed in an elevator machine room in an immediate vicinity of a drive machine of the elevator.

24. The arrangement according to any one of claims 20–23, wherein further comprising a wireless transmitter for transmitting the measurement data to a receiver communicating with an elevator-specific monitoring terminal comprising a special card.

25. The arrangement according to claim 24, wherein the monitoring terminal sends the measurement data over a communication link to a maintenance center.

26. The arrangement according to claim 20, wherein the test run cycles are synchronized by individual tests having information collected about the door data, the car movement data and the car stopping data, a plurality of test run cycles being completed and a mean value for each test for each tested floor and each tested elevator car being compared against reference values corresponding to a normal condition or state of the elevator.

* * * * *